US006899156B2

(12) United States Patent
Tyner

(10) Patent No.: US 6,899,156 B2
(45) Date of Patent: May 31, 2005

(54) HEADRAIL WITH REVERSIBLE CORD LOCK POSITION

(75) Inventor: James D. Tyner, Clermont, FL (US)

(73) Assignee: ITA, Inc., St. Augustine, FL (US)

( * ) Notice: Subject to any disclaimer, the term of this patent is extended or adjusted under 35 U.S.C. 154(b) by 0 days.

(21) Appl. No.: 10/438,673

(22) Filed: May 15, 2003

(65) Prior Publication Data

US 2004/0226662 A1 Nov. 18, 2004

(51) Int. Cl.[7] ..... E06B 9/324

(52) U.S. Cl. ..... 160/178.1 R; 160/178.2; 160/902; 248/251

(58) Field of Search ..... 160/168.1 R, 173 R, 160/178.1 R, 178.2 R, 84.04, 84.05; 248/262, 251

(56) References Cited

U.S. PATENT DOCUMENTS 2,409,943 A 10/1946 Kwon
4,643,238 A 2/1987 Tachikawa et al.
4,646,808 A * 3/1987 Anderson ..... 160/178.2
4,719,956 A * 1/1988 Valle ..... 160/178.2
4,813,468 A * 3/1989 Fraser ..... 160/84.03
5,060,710 A 10/1991 Haarer
5,156,196 A * 10/1992 Corey et al. ..... 160/178.2
5,692,550 A 12/1997 Ford et al.
6,148,894 A 11/2000 Judkins

* cited by examiner

*Primary Examiner*—Blair M. Johnson
(74) *Attorney, Agent, or Firm*—Buchanan Ingersoll PC

(57) ABSTRACT

A headrail for a venetian type blind or pleated shade has an insert that carries a cord lock. The insert fits into the end of the headrail and is carried by a slot or rib on the sidewalls of the headrail. A pair of pockets are provided on the insert. The pockets are positioned so that one pocket is adjacent each sidewall when the insert is attached to the end of a headrail. The pockets are sized and configured to receive a cord lock such that the cord lock can be easily removed from one pocket and placed in the other pocket by an installer. The pockets preferably are oriented so that a cord passing through the cord lock will run along a path that is not parallel to the sidewalls but is at an angle of about 10°.

16 Claims, 8 Drawing Sheets

FIG. 5
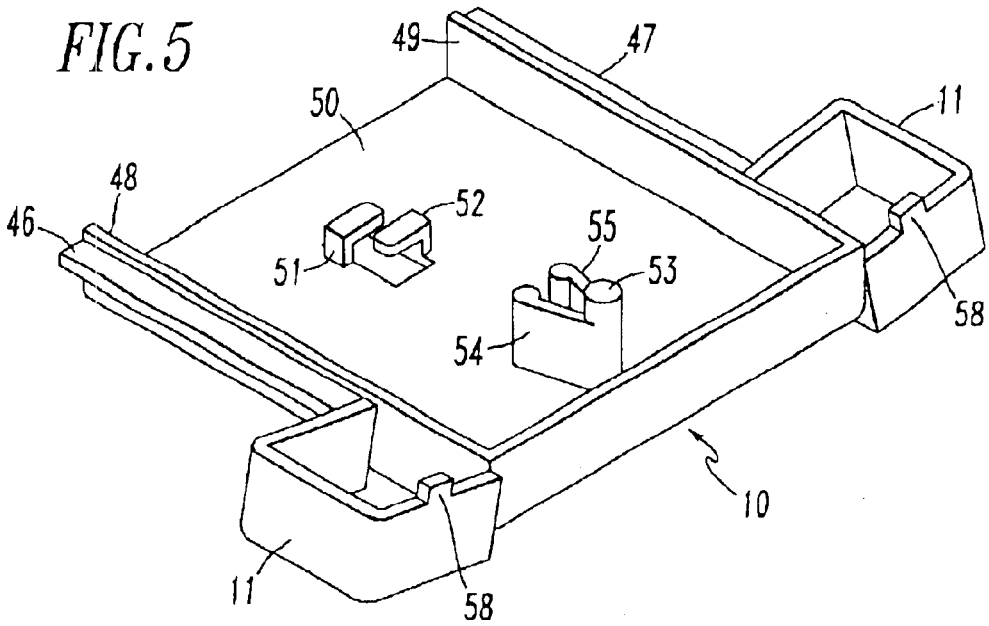
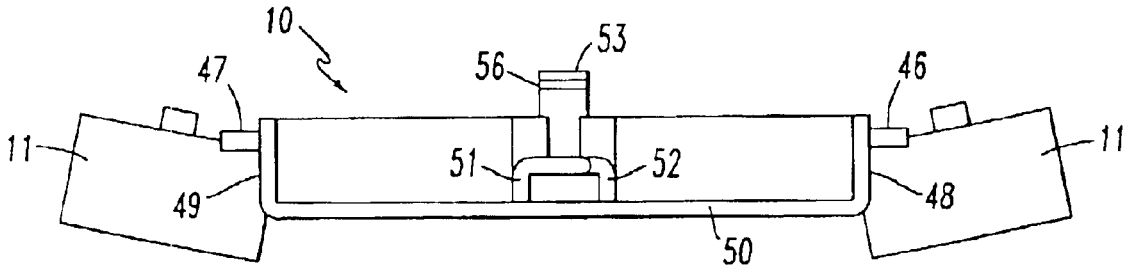
FIG. 6
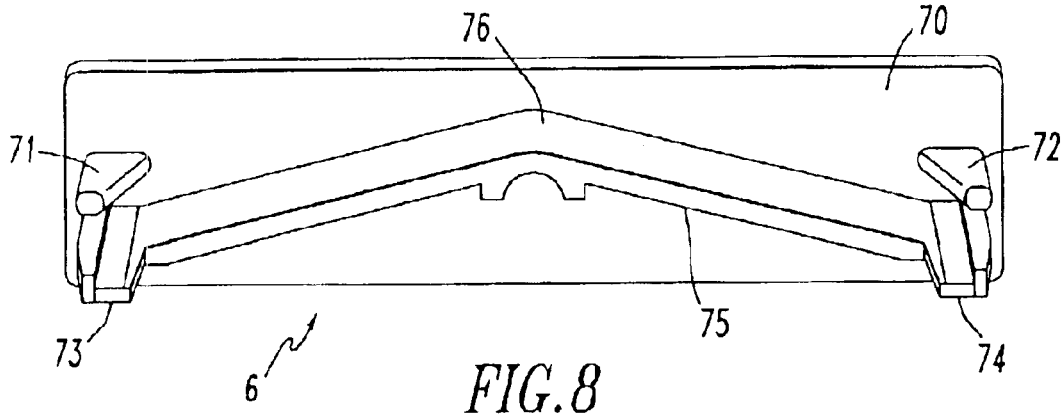
FIG. 8

FIG. 9
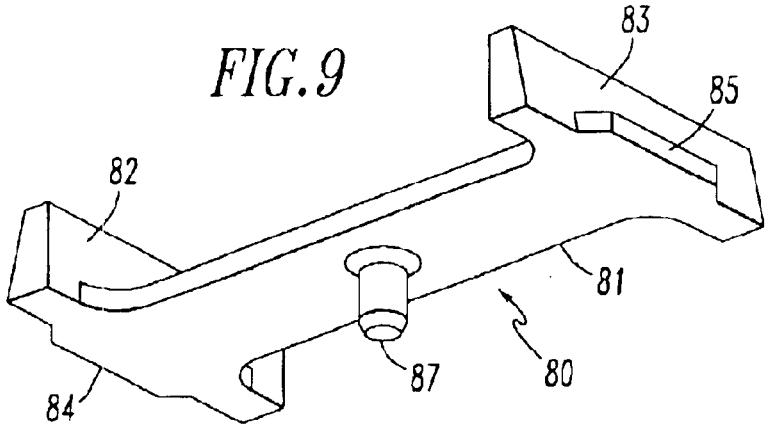
FIG. 10
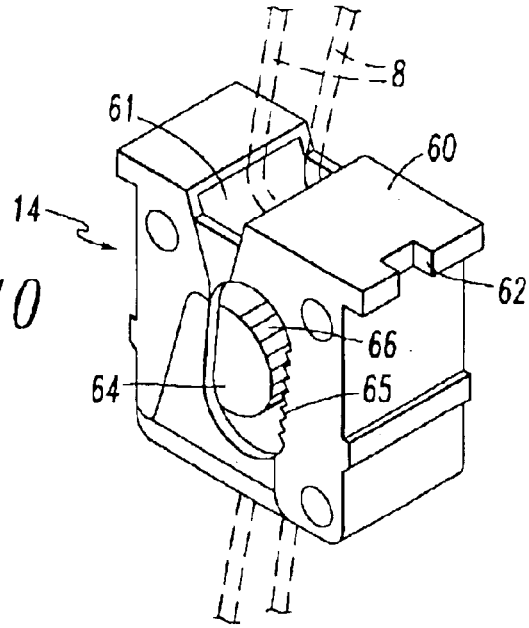
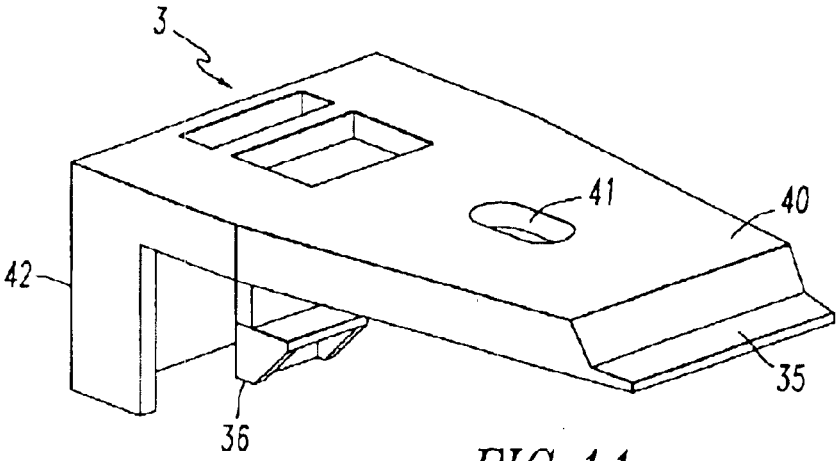
FIG. 11

HEADRAIL WITH REVERSIBLE CORD LOCK POSITION

FIELD OF INVENTION

The invention relates to headrails for venetian type blinds as well as headrails for pleated shades in which lift cords pass through a cord lock at one end of the headrail.

BACKGROUND OF THE INVENTION

Venetian type blinds, pleated shades, roman shades and roll-up blinds have lift cords for raising and lowering the window covering material. The lift cords extend from a bottomrail through or past the window covering material and into the headrail. The cords can be collected on a cord collector within the headrail or, more typically, exit one end of the headrail. In most of these blinds a cord lock is provided at one end of the headrail and the lift cords pass through that cord lock as they exit the headrail. The cord lock allows the user to maintain the blind in any desired position from fully raised to fully lowered.

It is common in the art to provide the tilt cords at one end of the headrail and the lift cords at the opposite end of the headrail as is disclosed in U.S. Pat. No. 2,409,943 to Kwon. The art has also positioned the tilt cords and lift cords at the same end of the headrail as disclosed in U.S. Pat. No. 4,643,238 to Tachikawa et al. Some headrails have been made with knockouts at both ends of the blind so that the same headrail can be used for blinds having controls on the right and blinds having controls on the left. When the blind is fabricated one of the knockouts is removed to provide an opening for the lift cords and tilt cords. It is also known to put a cord lock in an end cap that fits onto one end of the headrail such as is disclosed in U.S. Pat. No. 5,692,550. Such inserts are designed to fit into either the left end or right end of the headrail and are not reversible.

Nearly all blinds and pleated shades are fabricated in a factory and taken in finished form to the house or building where they will be hung by an installer. The installer mounts the brackets that hold the blind at each window location and may adjust the length of the blind at the time of installation. The salesman should ask the buyer if he or she has a preference as to whether the lift cords and tilt cords should be on the right side or the left side of the blind. If a there is a preference the factory ought to be notified so that the blind is fabricated according to the customer's preference. If the installer delivers a conventional blind with the controls on the wrong side, he cannot change the location of the blind controls in the field and must return that blind to the factory. Although some installers have the skills and the tools to fabricate blinds in their shop they seldom reconfigure blinds in their shop to change the position of the controls because that is a time consuming process. It is easier and less costly for the installer to simply return the blind to the factory. Each return means that the installer must make a second trip to the home or business thereby increasing the cost of the sale to both the manufacturer and the installer. Furthermore, if an installer is required to return to a home to replace a blind, very often the customer will ask the installer to make other changes or adjustments. Then the installer must spend even more time on that sale. Consequently, there is a need for a headrail for venetian blinds and pleated shades in which the installer can change the position of the cord lock from one end of the headrail to the opposite end of the headrail in the field where the window covering is being installed.

In U.S. Pat. No. 6,148,894 Judkins discloses a headrail having reversible modular controls allowing the cord lock to be positioned at either end of the headrail. The headrail has two sidewalls that are spaced apart, generally parallel and attached to the base. Each sidewall has a slot sized to receive a plug or a fitting through which the lift cords and tilt cords or a hook for a tilt wand pass. The slots are opposite one another and of a same size. One changes the controls from one end of the headrail to the opposite end of the headrail by moving the lift cords and tilt cord or hook from one slot to the other slot. This requires that slots be cut in the sidewalls and a plug be provided for one of the slots.

Consequently, there is a need for a headrail in which the installer can change the position of the cord lock from one end of the headrail to an opposite end at the time the headrail is installed. Preferably the headrail can be made from existing extrusions that are currently being used for headrails.

SUMMARY OF THE INVENTION

I provide a headrail for venetian type blinds and pleated shades in which the cord lock can be easily switched form the right side of the blind to the left side of the blind or vice versa. The headrail has an elongated body having a base, a first sidewall and a second sidewall. The first and second sidewalls are spaced apart, generally parallel and attached to the base. At least one channel or rib is provided on the inside surface of each sidewall. Preferably the rib or channel extends the full length of the blind. However, the rib or channel need only be at the ends of the headrail. I provide an insert or endcap that fits into the end of the headrail and is carried by the slot or rib on the sidewalls. A pair of pockets are provided on the insert, the pockets being positioned so that one pocket is adjacent each sidewall when the insert is attached to the end of a headrail. The pockets are sized and configured to receive a cord lock such that the cord lock can be easily removed from one pocket and placed in the other pocket by an installer.

I prefer that the pockets be oriented so that a cord passing through the cord lock will run along a path that is not parallel to the sidewalls but is at an angle. I prefer that the angle be about 10°.

Other objects and advantages of the present invention will become apparent from a description of the present preferred embodiments shown in the drawings.

BRIEF DESCRIPTION OF THE FIGURES

FIG. 5 is perspective view of the cord lock-carrying insert in the embodiment shown in FIG. 1.

FIG. 6 is an end view of the insert shown in FIG. 5 viewed from the end that is inserted into the headrail.

FIG. 8 is a perspective view of the end cap used in the embodiment shown in FIG. 1.

FIG. 9 is a perspective view of the optional cord guide shown in FIG. 4.

FIG. 10 is perspective view of a present preferred cordlock used in the embodiment shown in FIG. 1.

FIG. 11 is a perspective view of the present preferred mounting bracket used in the embodiment of FIG. 1.

DESCRIPTION OF THE PREFERRED EMBODIMENTS

Figure 1:
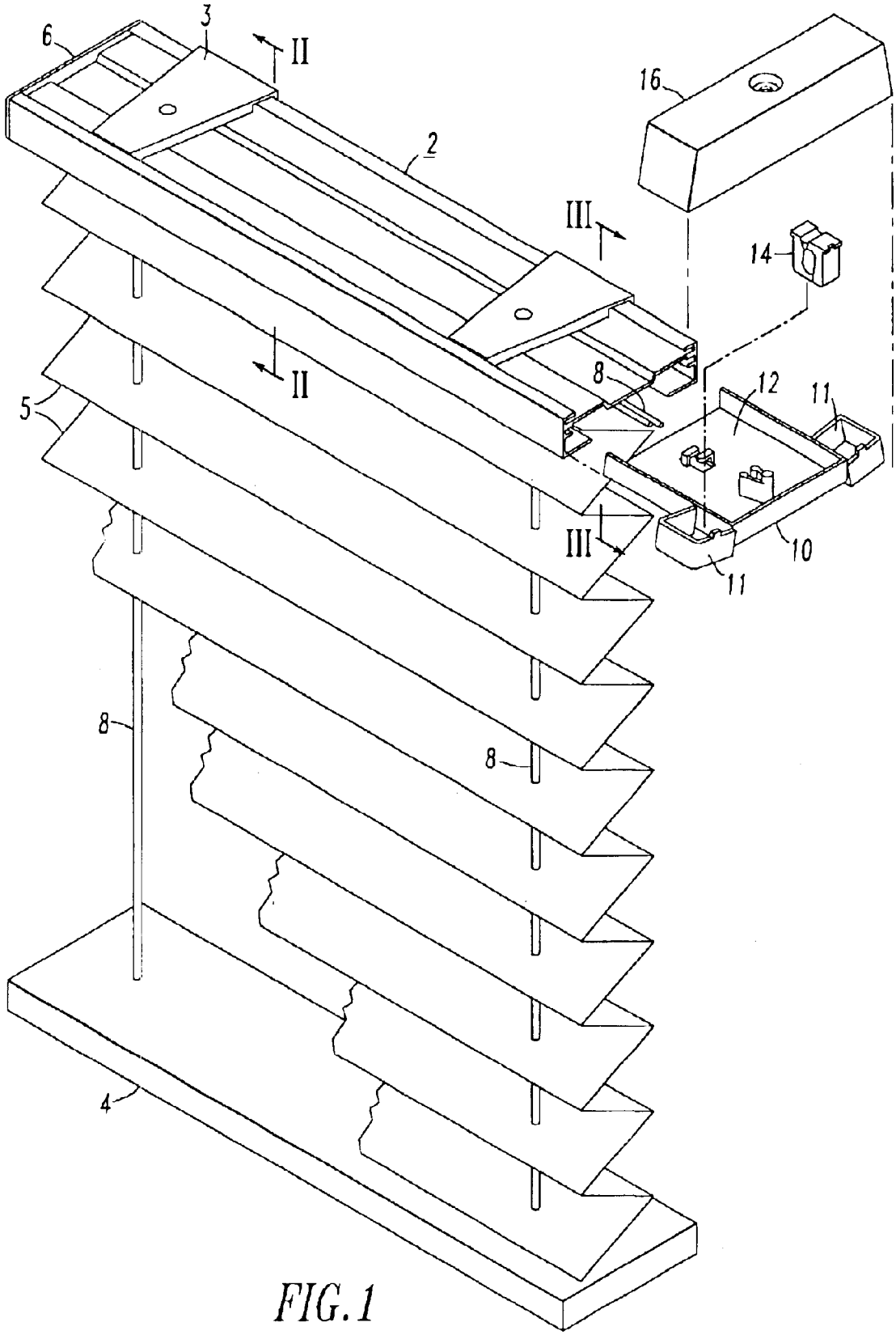
FIG. 1 is an exploded view of a pleated shade having a headrail made in accordance with the present invention.

As shown in FIG. 1 a window covering which utilizes the headrail and insert of the present invention is comprised of an elongated body or headrail 2, a bottomrail 4 and a pleated window covering material 5 extending therebetween. Although the embodiment shown in FIG. 1 is a pleated shade the present invention can be used with any window covering that contains a headrail and lift cords including cellular shades, roman shades and venetian blinds. End cap 6 is attached to one end of the headrail 2. Lift cords 8 pass from the bottomrail 4 into and through the headrail 2. The lift cords 8 may pass through holes in the window covering material 5 or be routed behind the window covering material. Within the headrail the lift cords 8 run to a cord lock 14. They pass through the cord lock 14 and are of a length that an operator of the blind can easily reach the end of the lift cords. The number of lift cords that are used will vary according to the size of the blind and the cording arrangement. The cord lock 14 is carried in a pocket 11 on an insert 10 that fits into either end of the headrail 2. The insert has two pockets 11 on opposite sides of the body 12 of the insert 10 that extend outward from the body 12. Insert 10 is pushed into the headrail until the pockets 11 abut the end of the headrail. Then a cover 16 is placed over the pockets. Insert 10 and end cap 6 can be placed in either end of the headrail 2. The assembly of elongated body or headrail 2, insert 10, cord lock 14, end cap 6 and cover 16 may also be called the headrail of the window covering by those skilled in the art.

As can be seen most clearly in FIGS. 2, 3, 4 and 5 the headrail 2 has a pair of spaced apart side walls 21 and 22 that extend from spaced apart bottom segments 23 and 24. The opening between bottom segments 23 and 24 enables the window covering material to be connected to a bar 25 shown in FIG. 2 that can be slid into head rail from either end. If the headrail is used for a venetian blind the cord guide 80 shown in FIGS. 4 and 9 could be used rather than a bar. A top 30 with a central depression 34 extends between the upper portions of the sidewalls 21 and 22. Rails 27 and 28 are provided on side rails 21 and 22 between the top 30 and bottom segments 23 and 24 such that each rail defines a slot 29. A set of top rails 31 and 32 above the top 20 each define another slot 31. The headrail shown in the drawings is preferred because it can be easily extruded. However, other configurations could be used. For example, slots could be cut in the sidewalls of the headrail or the insert to support the insert rather than use rails.

As can be seen in FIGS. 1 and 11, mounting brackets 3 are provided to attach the blind to a window frame. The mounting bracket is L-shaped having a top 40 and side or leg 42. A hole or slot 41 is provided in the top to permit a ceiling mount. Holes, not shown, are provided in leg 42 for a wall mount. Slot 31 on headrail 2 is provided to receive a tab 34 extending from each mounting bracket 3. A finger 36 extends from the top 41 of the mounting bracket 3 and fits under the opposite lower edge of one side 22 of the headrail as shown most clearly in FIG. 2. This finger can be pushed back toward the wall on which the bracket 3 is hung to release the headrail from the mounting bracket. The bracket can be a metal stamping but preferably is a molded plastic part.

Figure 7:
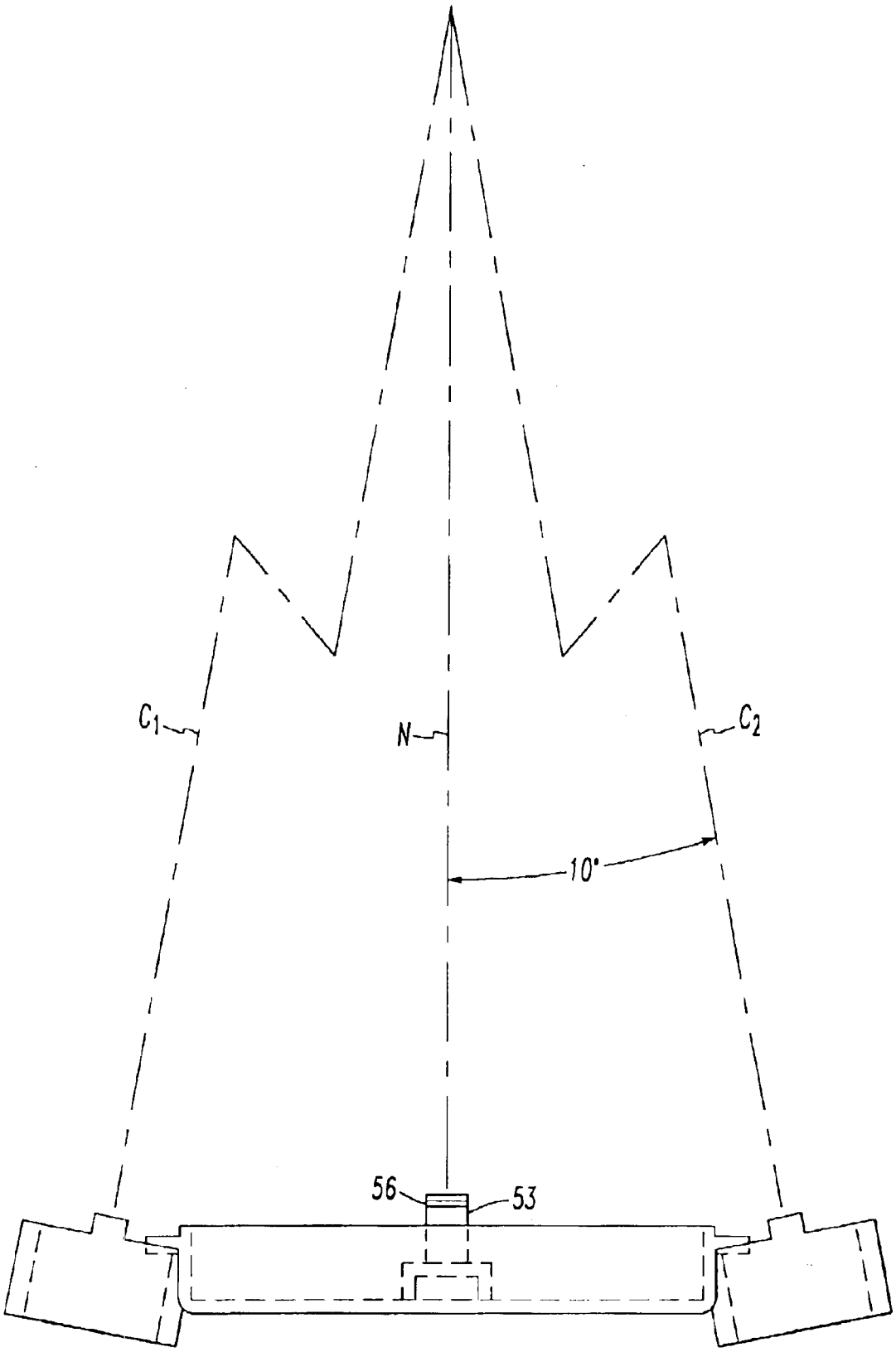
FIG. 7 is an end view similar to FIG. 5 showing the end of the insert that is not inserted into the headrail with the orientation of the pockets for the cord lock indicated by dotted lines.
Figure 12:
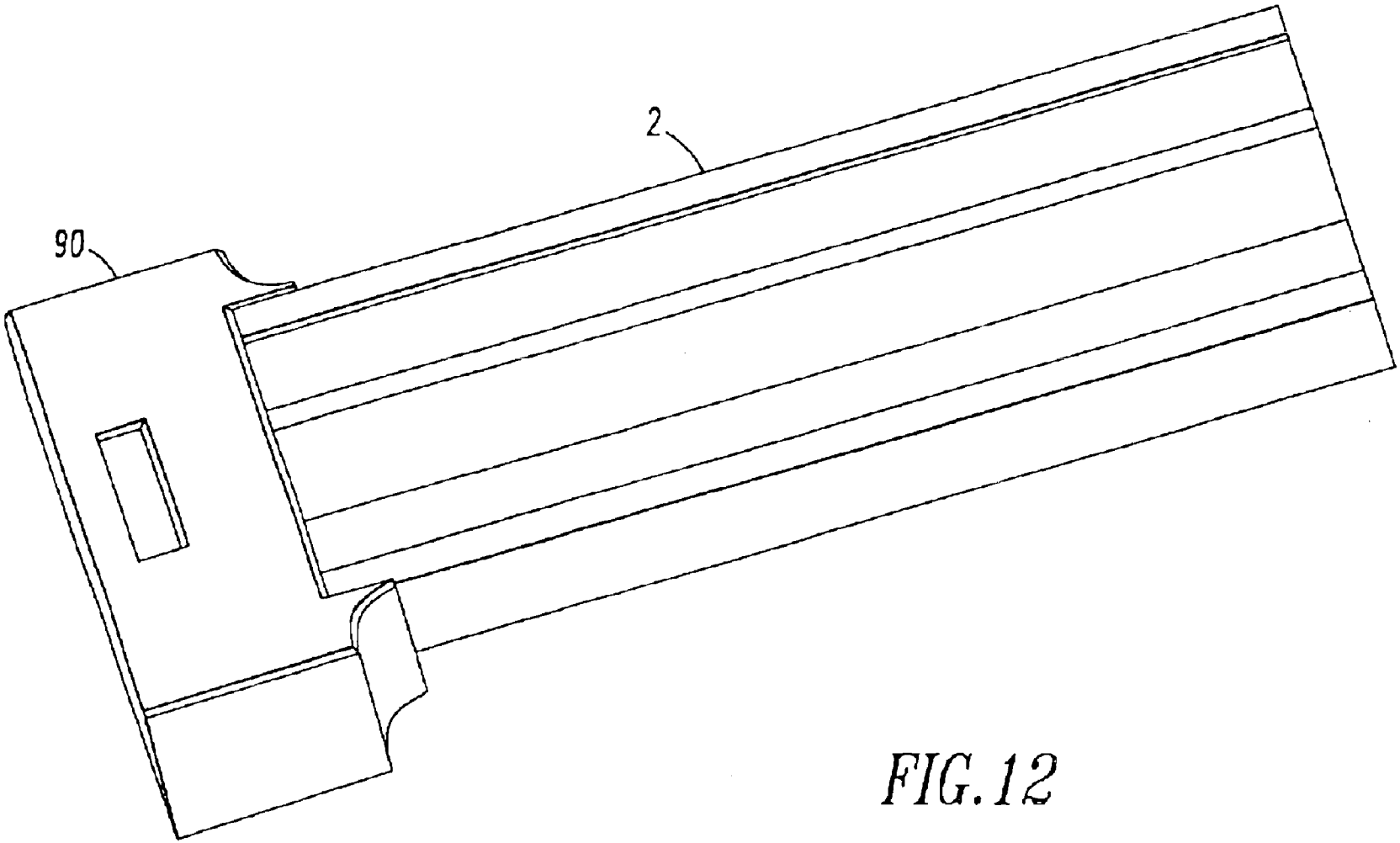
FIG. 12 is a perspective view showing the top of a second present preferred embodiment of my headrail.

Referring to FIGS. 5, 6 and 7 the insert 10 has a base 50 from which two generally parallel sides 48 and 49 extend. A rail 46 and 47 is provided on each side 48, 49 and is positioned to fit within slot 29 in the headrail 2. Two L-shaped fingers 51 and 52 extend upward from the base between the sides. The fingers together define a channel through which the lift cords are routed. A post 53 is in line with the fingers. Cord deflectors 54 and 55 extend from the post. If the cord lock is positioned in the pocket on side 48, the cord would be routed over deflector 55 to the cord lock. Should the cord lock be in the pocket on side 49, then the lift cords would be routed over deflector 54 to the cord lock. A tab 58 is provided on each pocket and sized to fit within a slot 62 provided in the cord lock 14 which is shown in FIG. 10. As can be seen most clearly in FIGS. 3 and 6 post 53 has a collar 56. After the insert has been placed within the headrail cover 16 is placed over the pockets 11 and pressed down until the collar 56 on post 53 fits through the top hole in the cover. This forms a snap fit keeping the cover 16 in place. I prefer that the pockets be oriented as shown in FIG. 7. A centerline $C_1$ or $C_2$ through each of the pockets intersects a line N normal to the base so that the centerline $C_1$ or $C_2$ forms an angle of 10° with line N. Orienting the pockets in this way causes the lift cords to enter the top of the cord lock at an angle relative to the vertical. When the lift cords leave the cord lock they will hang vertically until moved by an operator. Such an orientation biases the cord lock to a locked position.

I prefer to use the cord lock shown in FIG. 10. That cord lock 14 has a top 60 with an opening 61 through which the lift cords 8 shown in dotted line enter the cord lock. A slot 62 is provided on opposite sides of the top 60 to receive the tab 58 on pocket 11. The cord lock has a generally rectangular housing which contains a roller 64 having teeth 66. The chamber containing the roller is wider at the bottom than near the top 60. The teeth engage a serrated surface 65 on one side of the cord lock. This surface is angled such that as the roller moves up, the gap between the roller and the inside surface of the cord lock gets smaller until the cords are squeezed and locked in place. When an operator pulls the cords through the cord lock that causes roller 64 to move down opening the gap between the roller and the inside surface of the cord lock allowing the cords to easily pass. Because the pocket orients the cord lock at an angle the lift cords 8 will normally rest against the roller 64 and pull the roller upward if the operator lets go of the cords. This orientation thus creates an anti-crash feature preventing the window covering material from rapidly falling and crashing onto the window sill when an operator releases the lift cords. The cord lock shown in the drawings is a simple three piece design. Similar cord locks are well known in the art. The cord lock works in both the right hand and left hand orientation. The provision of a slot 62 in the cord lock requires that the lock be inserted in the correct orientation when placed in the pocket.

As can be seen most clearly in FIG. 8 the end cap 6 has a generally rectangular body 70. A pair of prongs 71 and 72 extend from one surface of the body. These prongs are positioned to fit within slot 29 in the headrail. Immediately below prongs 71, 72 are posts 73 and 74. These posts are at either end of rib 75 and positioned to rest on the bottom portions 23 and 24 of the headrail. The peak 76 of rib 75 will press against the top 30 of the headrail opposite recess 34. This arrangement provides a snug fit for the end cap.

Figure 4:
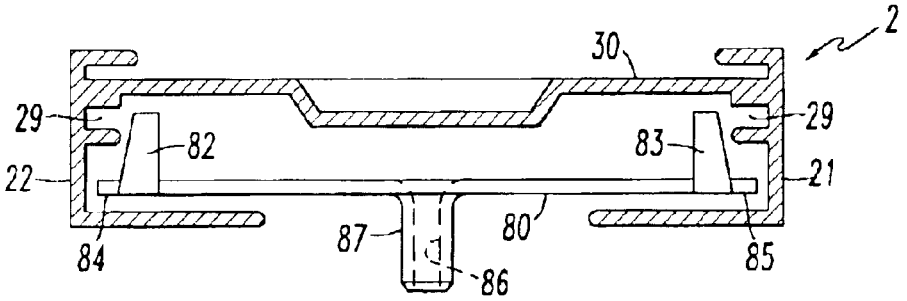
FIG. 4 is a sectional view taken of the headrail with an optional cord guide.

I prefer to provide a cord guide 80 shown in FIG. 9. The cord guide has an elongated body 81 with side walls 82 and 83. A rail 84 and 85 may extend from each of the sides 81 and 83. As can be seen in FIG. 4, the sides 82 and 83 rest on the bottom sections 23 and 24 of the headrail. There is a hole 86 at the center of the base. A tubular portion 87 surrounds and extends from the hole 86. A lift cord is routed from the headrail through the hole and tubular section through the window covering material to the bottom rail. A separate cord guide is used for each lift cord. The cord guides can easily be positioned anywhere along the headrail.

Since the cord guides, insert and cord locks are enclosed by the cap and headrail, one color of insert, cord guide and cord lock can be used for all blinds. The cord lock cover 16 and end cap 6 as well as the channel used for the headrail 2 can be color coordinated. If desired, the channel used for the headrail can also be used as the bottom rail. When that is done, end cap 6 shown in the FIG. 8 would be placed at each end of the channel. Consequently, the present headrail can be used for a wide variety of products with many of the parts being suitable for all products. Therefore, a fabricator can keep a smaller inventory of components.

Figure 13:
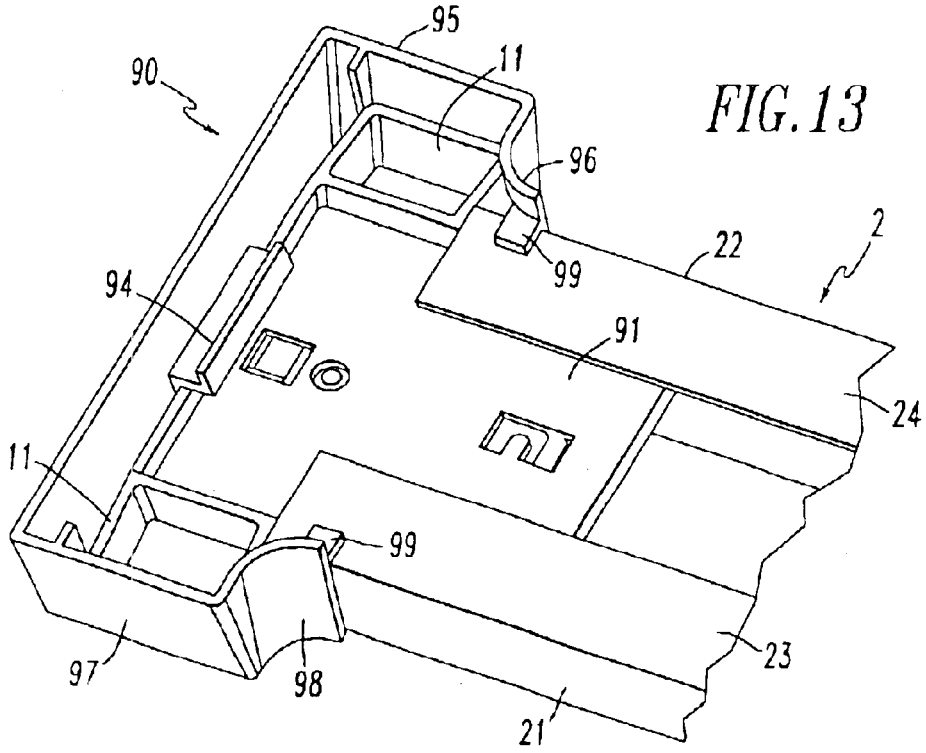
FIG. 13 is a perspective view showing the bottom of the second present preferred embodiment.
Figure 14:
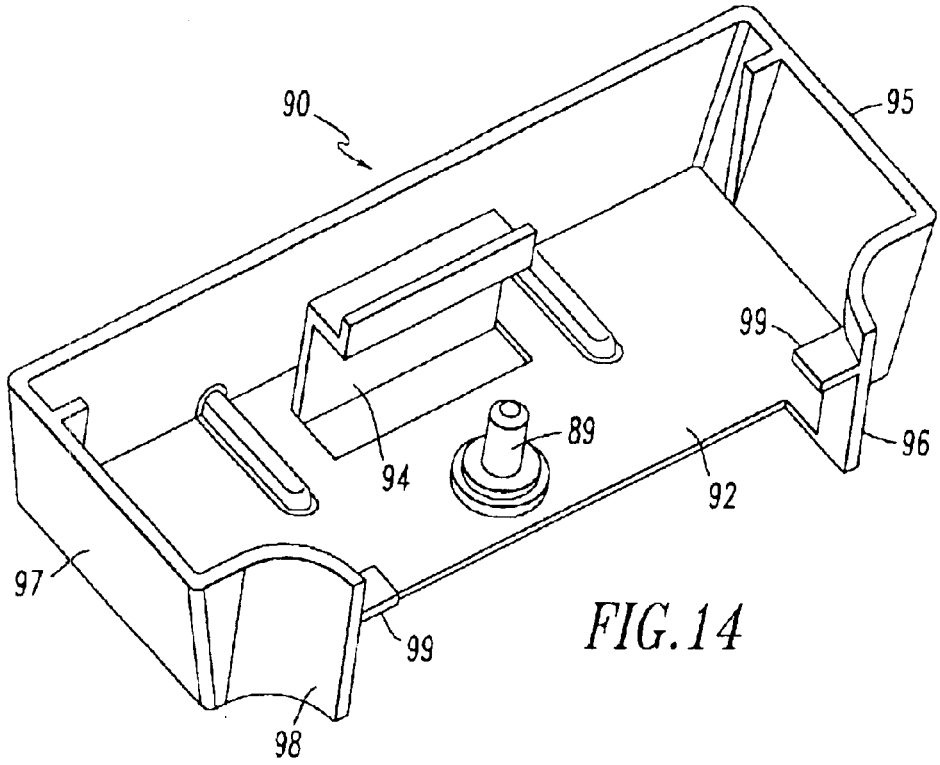
FIG. 14 is a perspective view of the cover used in the second present preferred embodiment.

A second preferred embodiment shown in FIGS. 12, 13, 14 and 15 uses the same elongated body or headrail 2 and a similar insert 91 with pockets 11. However, the cover 90 is different. This cover has a base 92 and two spaced apart sidewalls 95 and 97. A locking tab 94 extends from the base and snaps over the insert 91 as shown in FIG. 13. Post 89 extends from the base and fits into a mating hole in the insert. End portions 96, 98 of each sidewall 95, 97 extend over a portion of each sidewall 21, 22 of the headrail 2. A tab 99 extends from each end portion 99 and over the bottom segments 23, 24 of the elongated body 2. A fabric window covering, such as pleated material 5 shown in FIGS. 1 and 2, or cellular material shown in FIG. 15, can be installed to extend between the bottom segments 23 and 24 and one or both tabs 99 to prevent sideways slip of the fabric during application.

Figure 2:
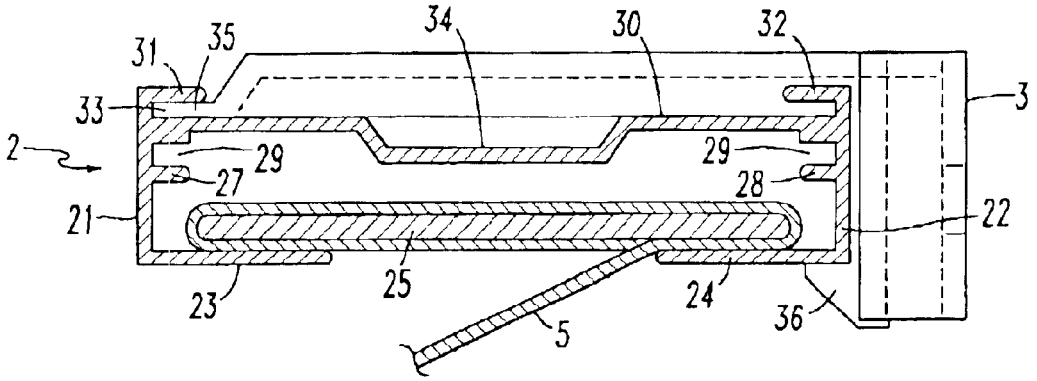
FIG. 2 is a sectional view taken along the line II—II FIG. 1.
Figure 3:
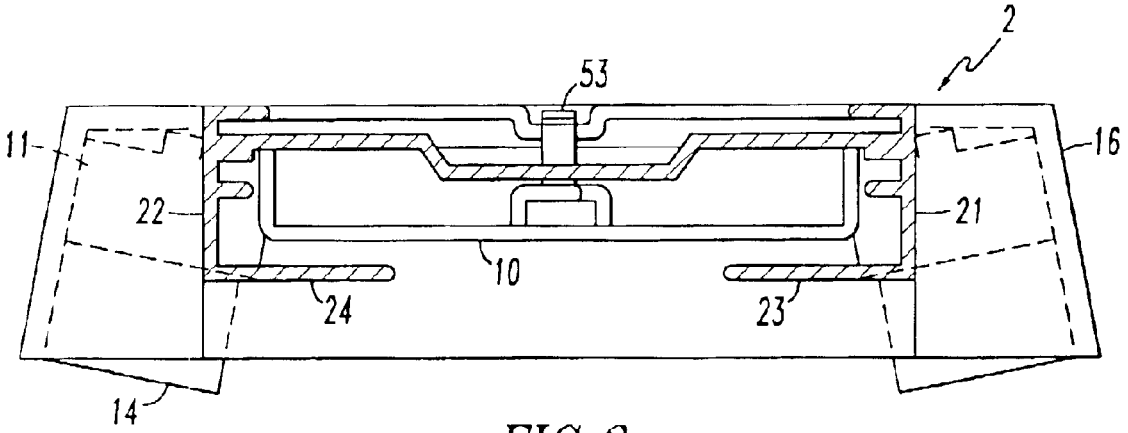
FIG. 3 is a sectional view taken along the line III—III of FIG. 1.
Figure 15:
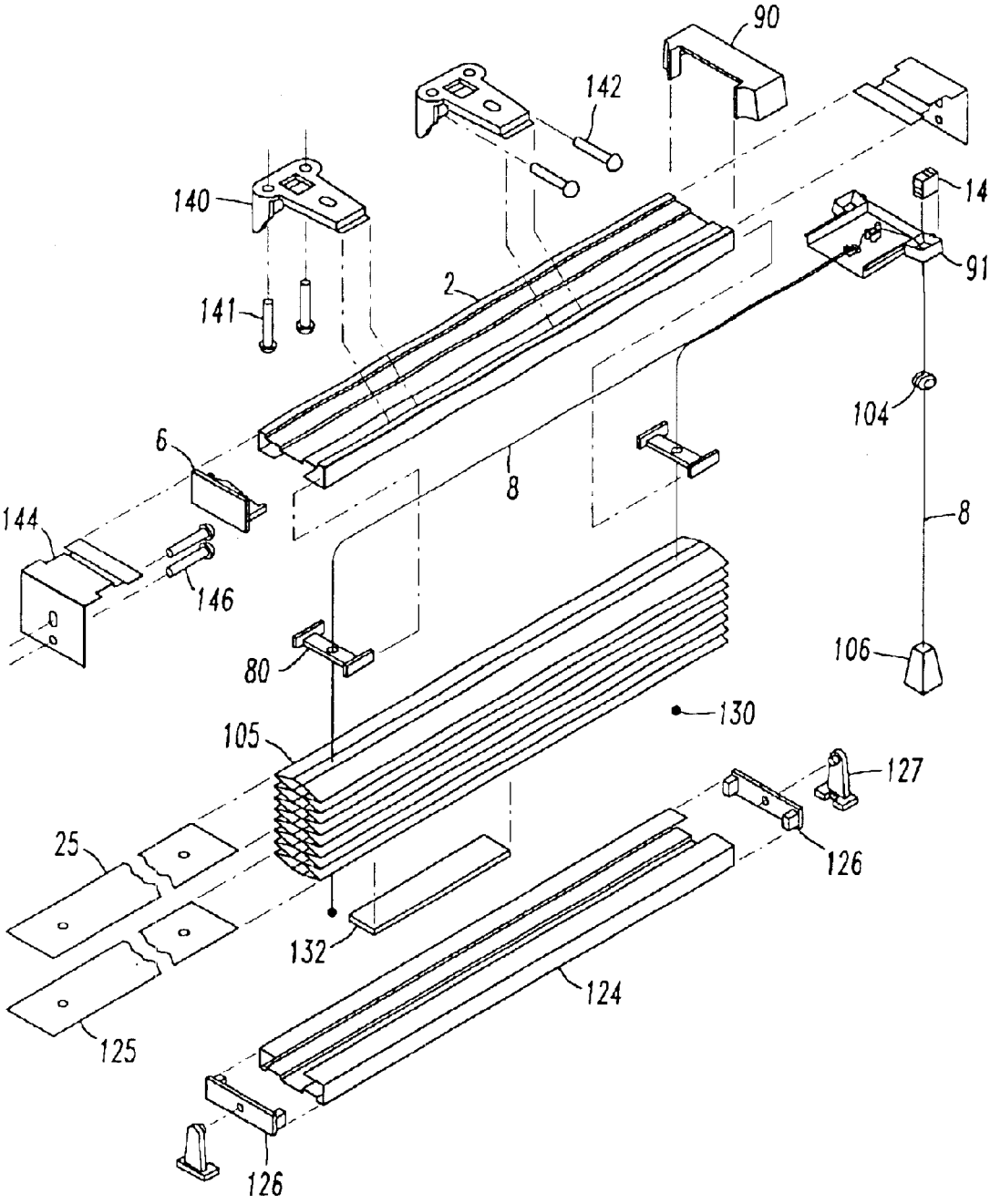
FIG. 15 is an exploded view of a cellular shade containing the second preferred embodiment of my headrail.

In the cellular shade shown in FIG. 15 the same extrusion is used for the headrail 2 and the bottomrail 124. Fabric is attached to the bottomrail in the same manner as fabric is attached to the headrail. Bars 25 and 125 are inserted into the top cell and the bottom cell. Then the headrail or bottomrail is fitted onto the bar containing cell so that the cell is contained within the extrusion as shown in FIG. 2. Endcaps 126 are inserted in opposite ends of the bottomrail. Tie downs 127 can be provided to secure the bottomrail to the window sill. A weight 132 may be placed in the bottomrail.

The headrail can be mounted to the window frame using brackets 140 which fit over one side of the headrail 2 or end brackets 144. Brackets 140 can be wall mounted using screws 142 or ceiling mounted using screws 141. End brackets 144 are wall mounted using screws 146.

The lift cords 8 extend from anchors 130 in the bottomrail 124 through the cellular material 105 and bars 25, 125 through cord guides 80 through the headrail and cord lock 14 to a cord reel 104. Those cords may continue to tassel 106 or end in the cord reel. A single cord would then be provided between the tassel and the cord reel.

The headrail of the present invention preferably has a thin profile being about ½ inch high, but can be made in any height. The width of the headrail is selected according to the window covering material to be used. Two sizes, a width of about two inches or about one and one half inch, will accommodate most known single-cell and double-cell fabrics as well as pleated fabrics. The length of the headrail is determined by the size of the window to be covered.

Although I have shown certain present preferred embodiments of my headrail it should be distinctly understood that the invention is not limited thereto, but may be variously embodied within the scope of the following claims.

I claim:

1. A headrail for window coverings having lift cords comprising:

an elongated body having a pair of spaced apart generally parallel sides, each side extending from a first end to a second end, a first top rail attached to one side and a second top rail attached to the other side of the elongated body, each top rail and attached side defining a slot sized to receive a tab of a mounting bracket;

an insert fitted within one of the first end and the second end, the insert comprising a body and a pair of pockets attached to the body such that one pocket is adjacent each of the sides;

a cord lock within one of the pockets;

at least one mounting bracket, the mounting bracket comprised of an L-shaped body having a top and a side and a tab attached to the top, the tab fitted into the slot defined by one of the top rails and one side of the elongated body; and a finger pivotably attached at one end to the top of the mounting bracket and having a projection at an opposite end, the projection engaging one of the sides of the headrail.

2. The headrail of claim 1 also comprising a cover positioned over the pockets and the cord lock.

3. The headrail of claim 1 also comprising a rail on each of the sides of the elongated body and a second pair of rails one of those rails on each side of the insert body, the rails positioned such that one rail on the insert engages one rail on the sides of the elongated body.

4. The headrail of claim 1 wherein the body of the insert has a base and a pair of side walls, one pocket attached to each side wall, the pockets positioned relative to the base of the insert such that a centerline through each pocket will intersect a line normal to the base at an angle of 10°.

5. The headrail of claim 1 also comprising at least one cord guide positioned within the headrail between the sides of the elongated body.

6. The headrail of claim 5 wherein the at least one cord guide is comprised of an elongated base having a hole through the base and a tubular portion attached to the base and surrounding the hole so that a cord may pass through the hole and through the tubular portion.

7. The headrail of claim 1 also comprising an end cap inserted into one end of the elongated body opposite the insert.

8. The headrail of claim 7 also comprising a cover positioned over the pockets and cord lock, the cover, elongated body and end cap all being color coordinated.

9. A headrail for window coverings having lift cords comprising:

an elongated body having a pair of spaced apart generally parallel sides, each side extending from a first end to a second end;

an insert fitted within one of the first end and the second end, the insert comprising a body and a pair of pockets attached to the body such that one pocket is adjacent each of the sides; and a cord lock within one of the pockets; and a cover positioned over the pockets and the cord lock, the cover comprised of;

a base having two spaced apart side walls attached to the base, an end portion of each sidewall extending over a portion of one side of the elongated body;

a tab attached to each end portion of each sidewall and extending over the elongated body; and a locking tab extending from the elongated body and engaging the insert.

10. A window covering comprising:

a. a headrail comprised of i. an elongated body having a pair of spaced apart generally parallel sides, each side extending from a first end to a second end, a first top rail attached to one side and a second top rail attached to the other side of the elongated body, each top rail and attached side defining a slot sized to receive a tab of a mounting bracket;

ii. an insert fitted within one of the first end and the second end, the insert comprising a body and a pair of pockets attached to the body such that one pocket is adjacent each of the sides;

iii. a cord lock within one of the pockets;

at least one mounting bracket, the mounting bracket comprised of an L-shaped body having a top and a side and a tab attached to the top, the tab fitted into the slot defined by one of the top rails and one side of the elongated body; and a finger pivotably attached at one end to the top of the mounting bracket and having a projection at an opposite end, the projection engaging one of the sides of the headrail, b. a bottomrail;

c. window covering material connected between the bottomrail and the headrail; and c. a plurality of lift cords, each lift cord running from the bottomrail through the window covering material, through the headrail and through the cordlock.

11. The window covering of claim 10 also comprising a cover positioned over the pockets and the cord lock within one of the pockets.

12. The window covering of claim 10 also comprising a rail on each of the sides of the elongated body and a second pair of rails one of those rails on each side of the insert body, the rails positioned such that one rail on the insert engages one rail on the sides of the elongated body.

13. The window covering of claim 10 wherein the body of the insert has a base and a pair of side walls, one pocket attached to each side wall, the pockets positioned relative to the base of the insert such that a centerline through each pocket will intersect a line normal to the base at an angle of 10°.

14. The window covering of claim 10 also comprising at least one cord guide positioned within the headrail between the sides of the elongated body and through which one of the lift cords passes.

15. The window covering of claim 14 wherein the at least one cord guide is comprised of an elongated base having a hole through the base and a tubular portion attached to the base and surrounding the hole the one lift cord passing through the hole and through the tubular portion.

16. A window covering comprising an elongated body having a pair of spaced apart generally parallel sides, each side extending from a first end to a second end;

an insert fitted within one of the first end and the second end, the insert comprising a body and a pair of rockets attached to the body such that one pocket is adjacent each of the sides; and a cord lock within one of the pockets; and a cover positioned over the pockets and the cord lock, the cover comprised of:

a base having two spaced apart side walls attached to the base, an end portion of each sidewall extending over a portion of one side of the elongated body;

a tab attached to each end portion of each sidewall and extending over the elongated body; and a locking tab extending from the elongated body and engaging the insert.

* * * * *

UNITED STATES PATENT AND TRADEMARK OFFICE

CERTIFICATE OF CORRECTION

PATENT NO. : 6,899,156 B2
DATED : May 31, 2005
INVENTOR(S) : James D. Tyner

It is certified that error appears in the above-identified patent and that said Letters Patent is hereby corrected as shown below:

Column 7,
Line 5, delete ";" and insert -- : --.
Line 40, delete "c." and insert -- d. --.

Column 8,
Line 28, change "rockets" to -- pockets --.

Signed and Sealed this

Twenty-third Day of August, 2005

JON W. DUDAS
*Director of the United States Patent and Trademark Office*